US005547044A

United States Patent [19]

Yamasaki

[11] Patent Number: 5,547,044

[45] Date of Patent: Aug. 20, 1996

[54] ELEVATOR HOIST APPARATUS AND MANUFACTURING METHOD THEREFOR

[75] Inventor: Shinji Yamasaki, Inazawa, Japan

[73] Assignee: Mitsubishi Denki Kabushiki Kaisha, Tokyo, Japan

[21] Appl. No.: 374,903

[22] Filed: Jan. 19, 1995

[30] Foreign Application Priority Data

Jan. 19, 1994 [JP] Japan ..... 6-004165

[51] Int. Cl.[6] ..... B66B 11/08

[52] U.S. Cl. ..... 187/254; 74/325

[58] Field of Search ..... 187/254, 266, 187/251; 74/325, 411, 411.5

[56] References Cited

U.S. PATENT DOCUMENTS

| | | | |
|---|---|---|---|
| 4,422,531 | 12/1983 | Ohtomi et al. | 187/254 |
| 4,433,755 | 2/1984 | Ohtomi | 187/20 |
| 4,569,423 | 2/1986 | Hirano | 187/20 |
| 5,025,894 | 6/1991 | Yamasaki | 187/254 |

*Primary Examiner*—Kenneth Noland
*Attorney, Agent, or Firm*—Leydig, Voit & Mayer

[57] ABSTRACT

An elevator hoist apparatus con, rising a base, a speed reduction mechanism mounted on the base and including an input shaft to which driving power source is to be connected and an output shaft to which a sheave is connected, and a cover mounted to the base and covering the speed reduction gear. The speed reduction mechanism my comprise a bearing pedestal mounted to the base and a plurality of parallel axis gears supported by the bearing pedestal. A positioning means is disposed between the base and the speed reduction mechanism for positioning the bearing pedestal of the speed reduction mechanism relative to the base. At least one of the bearing pedestals of the speed reduction mechanism may be at least partially supported by other of the bearing pedestals. The speed reduction gear mechanism includes an intermediate gear and wherein the bearing pedestal supporting the intermediate gear is in engagement with and supported solely by the bearing pedestal supporting the input shaft and the bearing pedestal supporting the output shaft. A method for manufacturing an elevator hoist apparatus comprises the steps of preparing a base, mounting to the base a speed reduction mechanism including an input shaft to be connected to a driving power source and an output shaft to be connected to a rope sheave, and mounting a cover for covering the speed reduction mechanism to the base.

9 Claims, 3 Drawing Sheets

ELEVATOR HOIST APPARATUS AND MANUFACTURING METHOD THEREFOR

BACKGROUND OF THE INVENTION

This invention relates to an elevator hoist apparatus having a speed reduction gear mechanism composed of parallel axis gears and manufacturing method therefor.

FIGS. 5 and 6 are views schematically illustrating the elevator hoist apparatus disclosed in Japanese Patent Laid-Open No. 57-156986, in which reference numeral I designates a machine frame installed in the machine room and reference numeral 2 designates a gear box made of cast-iron mounted to the machine frame 1. Within the gear box 2, a speed reduction gear mechanism 3 composed of parallel axis gear as shown in FIG. 6 is disposed. Reference numeral 4 is an input shaft of the speed reduction gear mechanism 3, 5 is an intermediate shaft, 6 is an output shaft, these shafts being supported at their opposite ends by the gear box 2 by means of bearings 7. Reference numerals 8 designates a first gear mounted to the input shaft 4, which is in engagement with a second gear 9 mounted to the intermediate shaft 5. Reference numeral 10 designates a third gear mounted to the intermediate shaft 5, which is in engagement with a fourth gear 11 mounted to the output shaft 6. These gears 8–11 are helical gears. Reference numeral 12 designates an electric motor connected to the input shaft 4, 13 is a drive sheave connected to the output shaft 6, 14 is a main rope wound around the drive sheave 13, 15 is an elevator car connected to one end of the main rope 14 and 16 is a counter weight connected to the other end of the main rope 14.

In the elevator hoist apparatus of the above construction, when the electric motor 12 is rotated, its rotating force is transmitted to the output shaft 6 through the first to fourth gears 8–11 to rotate the drive sheave 13 which causes the car 15 to ascend or descend. Also, at that time, lubricating oil stored at the bottom of the gear box 2 is splashed up, whereby the lubrication of the gears 8–11 is achieved. During this operation, the force acting on the sheave 1 through the main rope 14 due to the weights of the car 15 and the counter weight 16, the force due to the driving force of the gears 8–11 by the motor 12, the force due to the weight of the motor 12 and the like are all supported by the gear box 2 made of the cast iron.

Since the conventional elevator hoist apparatus has the gears 8–11 supported by the gear box 2 as described above, the loads of the elevator car 15, the counter weight 16 and the like as well as the loads generated during the operation act against the gear box 2 through the bearings 7 for the gears 8–11 of the speed reduction gear mechanism 3, so that the gear box 2 must be extremely strong. Therefore, in the conventional elevator hoist apparatus, the gear box 2 made of cast iron is provided with a large wall-thickness, resulting in a very large weight of the entire hoist apparatus and in a difficulty in handling during the manufacture and assembly of the hoist apparatus and the installation of the hoist apparatus.

Also, since the shape of the gear box 2 is box-shape and is relatively complicated, casing is difficult and the accurate positioning of the bearing-receiving holes to be formed in a side wall 2 of the gear box 2 is difficult, which has been one of the factors that causes the gear meshing accuracy to be deteriorated. Furthermore, during the assembly of the hoist apparatus, the gears and the shafts must be inserted into and assembled within the closed space defined by the box-shaped gear box 2 manually, making the assembly difficult.

SUMMARY OF THE INVENTION

Accordingly, one object of the present invention is to provide an elevator hoist apparatus free from the above-discussed problems of the conventional elevator hoist apparatus.

Another object of the present invention is to provide an elevator hoist apparatus that is light weight, easy to manufacture, high in machining accuracy and easy to assemble.

Still another object of the present invention is to provide a method for manufacturing an elevator hoist apparatus which is easy to carry out.

An embodiment of the present invention includes an elevator hoist apparatus having a base, a speed reduction mechanism mounted on the base and including an input shaft to which driving power source is to be connected and an output shaft to which a sheave is connected, and a cover mounted to the base and covering the speed reduction gear.

In another embodiment of the invention, the speed reduction mechanism comprises a bearing pedestal mounted to the base and a plurality of parallel axis gears supported by the bearing pedestal.

According to still another embodiment of the invention, the elevator hoist apparatus may include positioning means, disposed between the base and the speed reduction mechanism, for positioning the bearing pedestal of the speed reduction mechanism relative to the base.

According to yet another embodiment of the invention, the positioning means of the elevator hoist apparatus includes a base engagement portion which is an engagement portion formed in the base, a bearing pedestal engagement portion which is an engagement portion formed in the bearing pedestal of the speed reduction mechanism, and a positioning member in engagement with the base engagement portion and the bearing pedestal engagement portion to determine the relative position therebetween.

According to sill a further embodiment of the invention, the bearing pedestal of the speed reduction mechanism may include a plurality of bearing pedestals each supporting at least one of the parallel axis gears.

According to another embodiment of the invention, at least one of the bearing pedestal of the speed reduction mechanism is at least partially supported by other of the bearing pedestals.

According to another embodiment of the invention, the bearing pedestals of the speed reduction mechanism may include a plurality of bearing pedestals each supporting at least one of the parallel axis gears and directly mounted to the base.

According to yet another embodiment of the invention, the speed reduction gear mechanism may include an intermediate gear and wherein the bearing pedestal supporting the intermediate gear is in engagement with and supported solely by the bearing pedestal supporting the input shaft and the bearing pedestal supporting the output shaft.

According to a further embodiment of the invention, the speed reduction gear mechanism may include an intermediate gear and wherein the bearing pedestal supporting the intermediate gear is integrally provided on one of the bearing pedestal supporting the input shaft and the bearing pedestal supporting the output shaft and is in engagement with and supported solely by the other of the bearing pedestal supporting the input shaft and the bearing pedestal supporting the output shaft.

According to still another embodiment, a method for manufacturing an elevator hoist apparatus is provided. The method includes the steps of preparing a base, mounting to the base a speed reduction mechanism including an input shaft to be connected to a driving power source and an output shaft to be connected to a rope sheave, and mounting a cover for covering the speed reduction mechanism to the base.

According to another embodiment of the invention the method for manufacturing an elevator hoist apparatus may include the steps of preparing a base, mounting to the base a speed reduction mechanism including an input shaft to be connected to a driving power source and an output shaft to be connected to a rope sheave, and mounting a cover for covering the speed reduction mechanism to the base, the method further comprising the steps of forming a base engagement portion in the base, forming a bearing-pedestal engagement portion in the bearing pedestal, combining the bearing pedestals and the parallel axis gears to assemble the speed reduction mechanism, fitting a positioning member to the base engagement portion and the bearing pedestal engagement portion to position the bearing pedestal of the speed reduction mechanism with respect to the base, fixing the speed reduction gear mechanism to the base, and fixing a cover for covering the speed reduction gear mechanism to the base.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

EMBODIMENT 1

Figure 1:
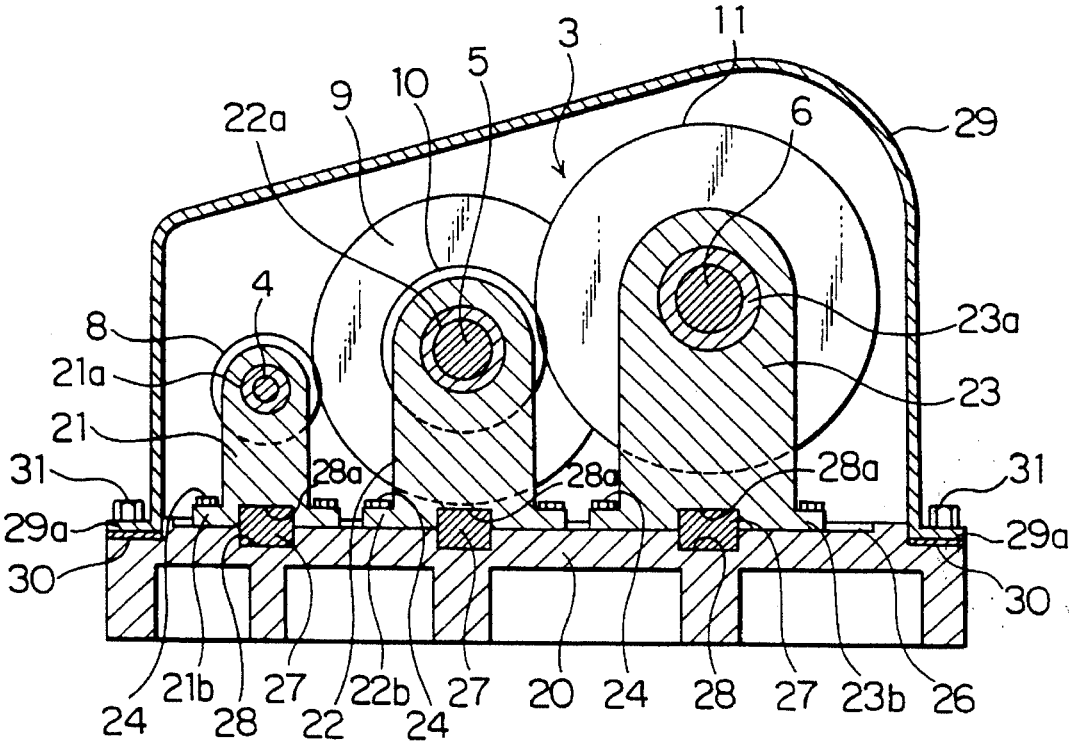
FIG. 1 is a sectional front view of the elevator hoist apparatus of the first embodiment of the present invention.
Figure 2:
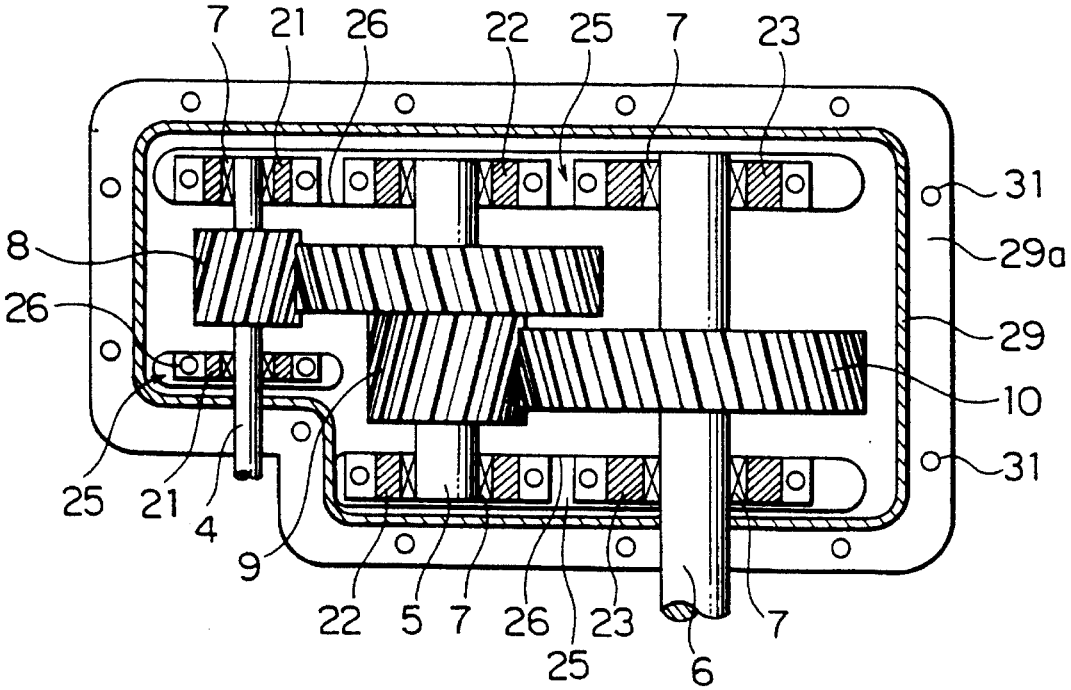
FIG. 2 is a plan view of the elevator hoist apparatus shown in FIG. 1.

FIG. 1 is a sectional front view illustrating the elevator hoist apparatus of the present invention and FIG. 2 is a plan view of the elevator hoist apparatus depicted in FIG. 1. According to one embodiment, the elevator hoist apparatus of the present invention comprises a base 20, a speed reduction mechanism 3 mounted to the base 20 and a cover 29 attached to the base 20 for covering the speed reduction mechanism 3.

Figure 5:
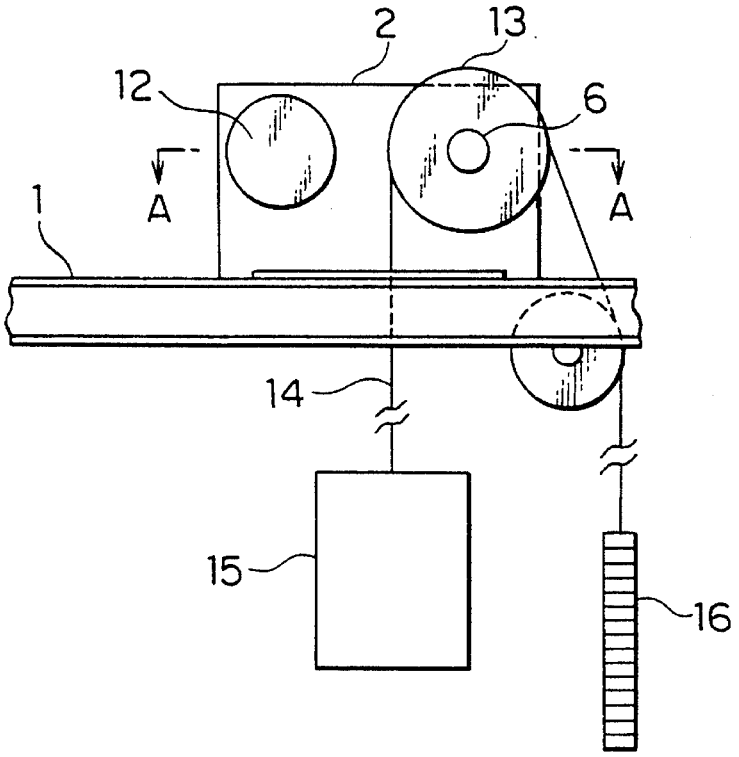
FIG. 5 PRIOR ART
FIG. 5 is a view illustrating the conception of the elevator hoist apparatus.
Figure 6:
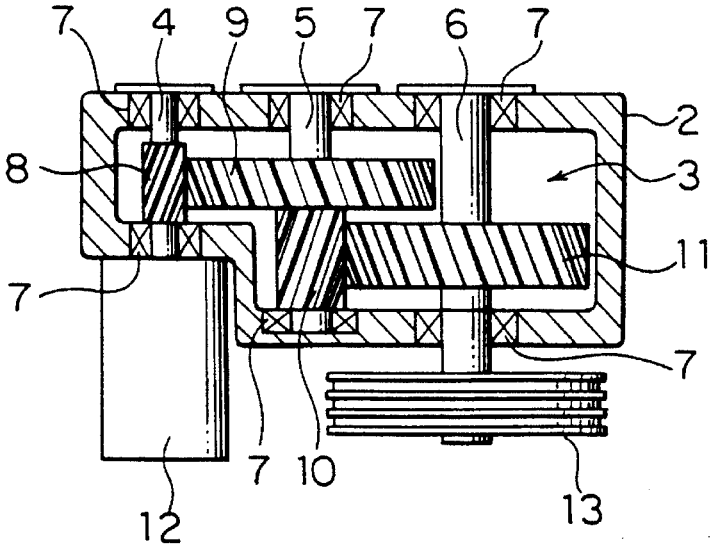
FIG. 6 PRIOR ART
FIG. 6 is a sectional plant view taken along line A—A and illustrating the conventional elevator hoist apparatus.

The speed reduction mechanism 3 comprises three bearing pedestals 21, 22 and 23 mounted to the base 20 and parallel axis gears 8, 9, 10 and 11 supported by the bearing pedestals 21, 22 and 23. The speed reduction mechanism 3 comprises an input shaft 4 to be connected to an electric motor (not shown in FIG. 1) which is a drive power source as shown in FIGS. 5 and 6, and an output shaft 6 to be connected to a sheave (not shown in FIG. 1) as shown in FIGS. 5 and 6. Therefore, in this embodiment, the parallel axis gear 8 on the input shaft 4 is an input gear, the parallel axis gear 11 on the output shaft 6 is an output gear, and two parallel axis gear 9 and 10 on the intermediate shaft 5 are intermediate gears. The input shaft 4 is supported by the bearing pedestal 21 alone through the bearing 21*a*. While one end of the input shaft 4 is supported by the bearing pedestal 21, the other end of the input shaft 4 is extended further beyond and outward of the bearing pedestal 21 and connected to the unillustrated drive power source. The intermediate shaft 5 is supported at its opposite ends only by the bearings 22*a* of the bearing pedestals 22, and the output shaft 6 is supported only by the bearing pedestals 23 through the bearings 23*a*. At the foot portion of each of the bearing pedestals 21, 22 and 23, mounting flanges 21*b*, 22*b* and 23*b* are provided for being secured to the base 20 by means of bolts 24.

The base 20 is a plate-like member made for example of cast iron arranged to be secured within the elevator machine room by unillustrated bolts or the like. The top surface of the base 20 has machined therein positioning grooves 26 for receiving and positioning the foot portion of the bearing pedestals 21, 22 and 23 of the speed reduction mechanism 3 in order to accurately mount the speed reduction mechanism 3 relative to the base 20. In these positioning grooves 26, a base engagement portion 28 for receiving and engaging positioning pins 27 which are positioning members and positioning them are provided. The positioning grooves 26 serves as reference surfaces for determining the elevational position as well as the axial position of the bearing pedestals 21, 22 and 23, and the base engagement portion 28 functions to position in the direction along the positioning groove 26 by the action of the positioning member 27 engaging with the bearing pedestal engagement portion 28*a* on the bearing pedestal which will be described later. In this sense, the bearing pedestal engagement portion 28*a* which is an engagement portion formed in the bearing pedestals 21, 22 and 23 of the speed reduction mechanism 3, the positioning member 27 engaging the base engagement portion 28 and the bearing pedestal engagement portion 28*a* for determining the relative position therebetween together constitute a positioning means disposed between the base 20 and the speed reduction mechanism 3 for positioning the bearing pedestals 21, 22 and 23 of the speed reduction mechanism 3 relative to the base 20.

The cover 29 is a relatively thin metallic plate press-formed into a configuration suitable for covering the speed reduction mechanism 3 and is provided with amounting flange 29*a* at its open mouth portion. The cover 29 is an integral member in the illustrated embodiment, but may be a combination of a plurality of components. The cover 29 is sealed oil-tightly along the circumferential edge portion of the base 3 by means of a seal 30 disposed along the mounting flange 29*a* to contain lubricating oil within. In the side wall of the cover 29, a seal means (not shown) such as an oil seal for oil-tight seal while allowing the rotation of the input shaft 4 and the output shaft 6 in order to prevent the lubricating oil from leaking from the gap between the cover 29 and the input shaft 4 and the output shaft 6 extending outwardly of the cover 29 from the speed reduction mechanism 3.

In manufacturing the elevator hoist apparatus of the constitution as described above, a speed reduction mechanism assembly is assembled by manufacturing the base 20 having formed therein the base engagement portions 28, forming the bearing pedestal engagement portions 28*a* in the foot portion of the bearing pedestals 21, 22 and 23 of the speed reduction mechanism 3, and coupling the parallel axis gears 8, 9, 10 and 11 to the bearing pedestals 21, 22 and 23 to assemble the speed reduction mechanism 3. Then, the positioning member 27 is caused to engage the bearing pedestal engagement portion 28*a* formed in the bearing pedestals of the speed reduction mechanism assembly and the base engagement portion 28 formed in the base 20 to position the bearing pedestals 21, 22 and 23 of the speed reduction mechanism assembly relative to the base 20. The speed reduction mechanism assembly thus accurately positioned is secured to the base 20 by means of bolts or the like, thereby mounting the speed reduction mechanism 3 to the base 20. Finally, the cover 29 for covering the speed reduction mechanism 3 is secured to the base 20, whereby the elevator hoist apparatus is manufactured.

In the elevator hoist apparatus thus constructed, when the unillustrated drive motor connected to the input shaft 4 is rotated, the input gear 8 on the input shaft 4 is rotated to transmit the rotational force to the output gear 11 on the output shaft 6 through the intermediate gears 9 and 10 on the intermediate shaft 5, thus rotating the unillustrated sheave connected to the output shaft 11. The rope is wound around the sheave so that the elevator car and the counter weight may be moved along the hoistway.

During this time, the driving force from the drive power source, the actions between the gears, loads on the sheave, etc. are all transmitted through the bearing pedestals 21, 22 and 23 to the base 20 where they are supported, and they are not at all transmitted to the cover 29 covering the speed reduction mechanism 3.

Therefore, the cover 29 does not have to have a high strength, and the thin-wall sheet-like cover 29 can be used, advantageously resulting in the reduction of the weight of the hoist apparatus, improving the operability during the assembly and manufacture of the hoist apparatus, the installation of the hoist apparatus and the like. Also, since the thin walled cover 29 is relatively single in configuration, manufacture is easy, the shaft through holes formed in the side wall of the cover 29 can be easily formed and their positional accuracy required is lower than that for the bearing-receiving holes.

Since the meshing accuracy of the gears of the speed reduction mechanism 3 is determined by the positional accuracy of the bearing pedestals 21, 22 and 23 positioned by means of the positioning means, the meshing accuracy can be very high. The distances between the opposing bearing pedestals are determined by bringing the front of the bearing pedestals 21, 22 and 2*a* into abutment against the side wall of the positioning grooves 25 and 26 of the base 20, and the distances between the gear shafts are determined by fitting the positioning members 27 within the positioning grooves 26 to bridge between the bearing pedestals 21, 22 and 23 and the base 20. Also, the machining of the bearing pedestals 21, 22 and 23 to form the bearing insertion holes and the engagement portions 28, 28*a* as well as the machining of the base 20 to form the positioning grooves 225 and 26 and the engagement portions 28 and 28*a* can be achieved individually on the respective components, so that the machining is easy and improved in accuracy and the positioning of the gear shafts 4–6 can be achieved in precision. Since the positioning means is simple in structure and relatively easy in machining, the manufacture can be achieved at a low cost. When a plurality of positioning members 27 are arranged to fit to each of the bearing pedestals 21, 22 and 23, the guide groove 25 may be omitted.

Also, during the assembly of the hoist apparatus, the assembly of the speed reduction mechanisms 3 can be carried out on the plate-like base 20 which is open at all directions, so that the assembly operation is easy, which is in contrast to the conventional apparatus wherein the difficult assembling operation of inserting the gears and the shafts into the closed space within the box-shaped gear box 2 and assembling the speed reduction mechanism 3 by hand within the confined space.

Also, the assembly of the bearing pedestals 21, 22 and 23 to the parallel axis gears 8, 9, 10 and 11 as well as the assembly of the speed reduction mechanism assembly thus assembled to the base 20 are very easy because the assemblies can be carried out in a free space where the hands can move freely and the components can be viewed by eyes. Since the bearing pedestals are independently arranged for each gear shaft, when each of the bearing pedestals 21, 22 and 23 is to be mounted to the base 20, it is only required that the parallel axis gears 8 to 11 be brought into engagement, providing an advantage that the need for the gears be previously brought into engagement with each other upon the assembly of the speed reduction mechanism assembly is eliminated.

EMBODIMENT 2

Figure 3:
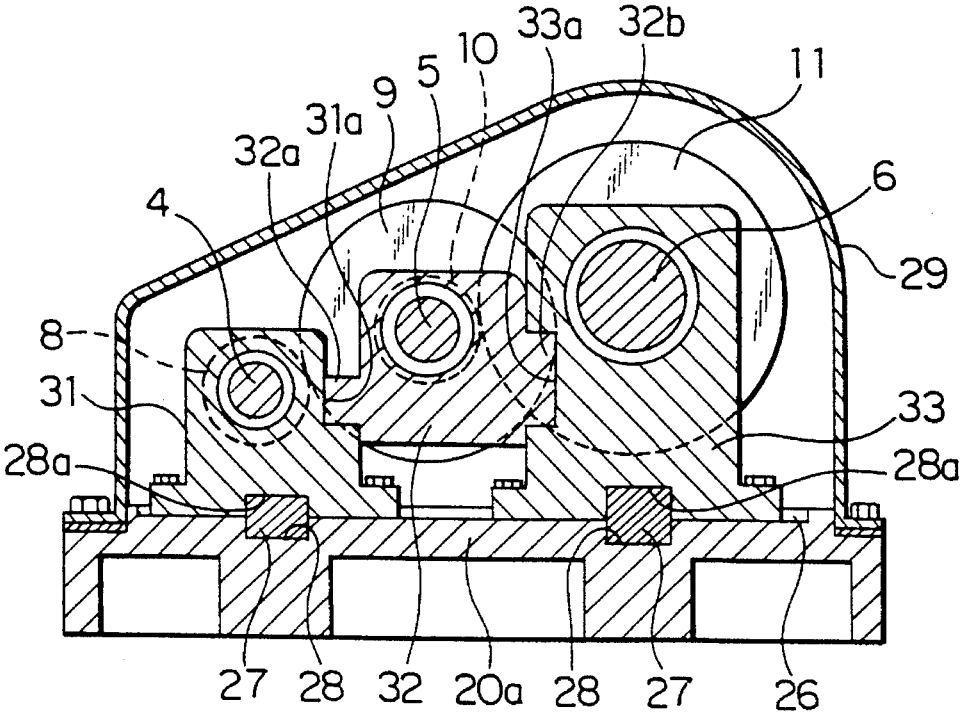
FIG. 3 is a sectional front view of the elevator hoist apparatus of the second embodiment of the present invention.

In the embodiment illustrated in FIG. 3, bearing pedestals 32 which support the intermediate gears 9 and 10 mounted on the intermediate shaft 5 of the speed reduction mechanism 3 are in engagement with bearing pedestal 31 for supporting the input shaft 4 and a bearing pedestal 33 for supporting the output shaft 6 Bearing pedestals 31 and 33 provide the sole support mechanism for input shaft 4 and output shaft 6, respectively. That is, the bearing pedestal 31 supporting the input shaft 4 has formed therein a positioning engagement portion 31*a*, the bearing pedestals 33 supporting the output shaft 6 has formed therein a positioning engagement portion 33*a*, and the intermediate bearing pedestals 32 supporting the intermediate shaft 5 has formed on its opposite side surfaces projections 32*a* and 32*b*, which projections 32*a* and 32*b* are in engagement with the engagement portions 31*a* and 33*a* of the bearing pedestals at both sides to be securely supported. Therefore, the intermediate bearing pedestal 32 is , although not directly fixed to the base 20*a*, precisely positioned and securely mounted to the base 20 by the bearing pedestals 31 and 33 at both sides. In other respects, this embodiment is similar to the above embodiment. Thus, each of the bearing pedestals 31, 32 and 33 are positioned and secured relative to the base 20*a*.

In this elevator hoist apparatus, since the intermediate bearing pedestals 32 are not directly mounted to the base 20*a*, the space required for securing the bearing pedestals 22 for supporting the intermediate shaft to the base 20 in the previous embodiment shown in FIGS. 1 and 2 is not necessary, so that the distance between the input shaft 4 and the output shaft 6 can be made small, improving the degree of freedom of design and making the apparatus small. Also, since the bearing pedestals 31 and 33 serves as a mounting member for mounting the intermediate bearing pedestals 32 to the base 20*a*, the positioning pins 27 or bolts 24 for the intermediate bearing pedestals 32 are not necessary, decreasing the number of components and the number of assembly steps and advantageous in cost.

EMBODIMENT 3

Figure 4:
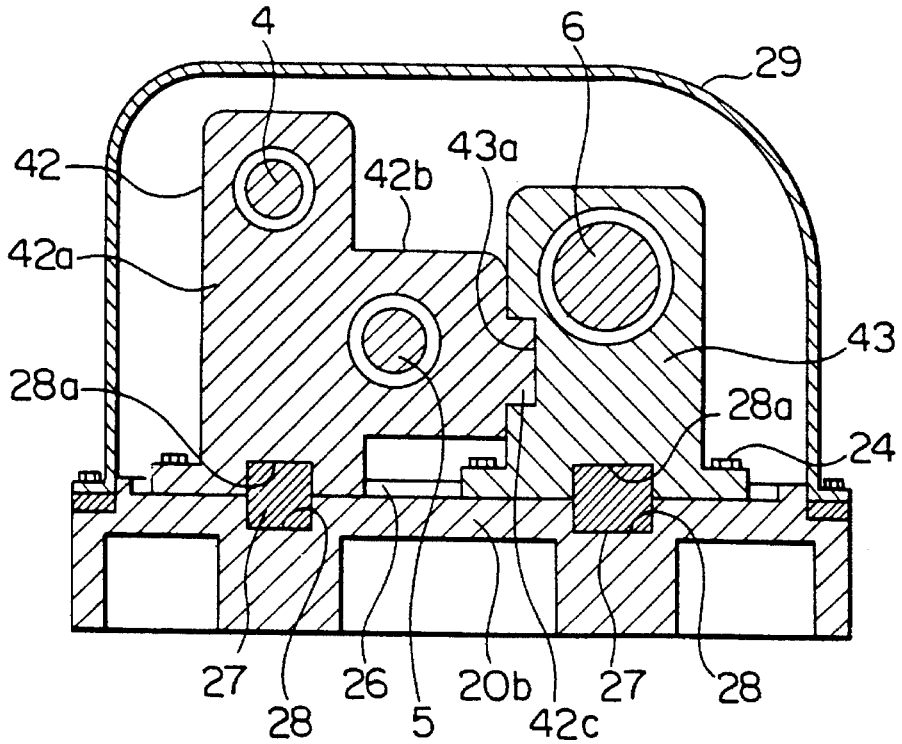
FIG. 4 is a sectional front view of the elevator hoist apparatus of the third embodiment of the present invention.

In the embodiment illustrated in FIG. 4, the bearing pedestal supporting the input shaft 4 and the bearing pedestal supporting the intermediate shaft 5 are constructed in an integral structure which is a common bearing pedestal 42. That is, the common bearing pedestal 42 is positioned at a foot portions to the base 20*b* by means of the positioning means composed of the positioning grooves 25 and 6, the base engagement portion 28, the bearing pedestal engagement portion 28*a* and the positioning member 27 and secured by the securing means such as the bolts 24 to the base 20*b*. The common bearing pedestal 42 comprises a bearing pedestal portion 42*a* supporting the input shaft 4 and a bearing pedestal portion 42*b* integral with the bearing pedestal portion 42*a* and supporting the intermediate shaft 5. The bearing pedestal section 42*b* comprises an engagement portion 42*c* which engages by fitting into an engagement portion 43*a* of a bearing pedestal 42 supporting the output shaft 6.

In this case also, the installation space on the bearing pedestal 20*b* is saved and the distance between the input shaft 4 and the output shaft 6 can be made small, improving the degree of design freedom and allowing the hoist apparatus to be compact and light-weight. Also, since the positioning member 27 and the bolts 24 for the intermediate bearing pedestal portion 42*b* supporting the intermediate shaft are not necessary, the number of the components and assembly steps is decreased and advantageous in cost.

It is also possible to make the bearing pedestals 21, 22 and 23 for supporting the input shaft 4, the intermediate shaft 5 and the output shaft 6 integral to provide a single bearing pedestal of one-piece structure. With this structure, although the assembly of the parallel axis gears 8 to 11 are less simple and easy, the strength and the rigidity can be improved.

As has been described, according to the elevator hoist apparatus of the present invention, a speed reduction mechanism including an input shaft and an output shaft is mounted to the base, and a cover for covering the speed reduction mechanism is also mounted to the base, so that the shaft loads of the speed reduction mechanism are all applied to the bearing pedestals, without being applied to the cover at all. Therefore, the cover can be of small rigidity, enabling the reduction in weight of the overall apparatus. Also, since the assembly of the speed reduction mechanism to the base can be carried out before the cover is secured, the assembly is very easy.

In the elevator hoist apparatus, the speed reduction mechanism comprises a plurality of parallel axis gears supported by the bearing pedestals mounted to the base, so that the parallel axis gears of the speed reduction mechanism are supported by the bearing pedestals mounted to the base as independent parts.

The elevator hoist apparatus, further comprises positioning means, disposed between the base and the speed reduction mechanism, for positioning the bearing pedestal of the speed reduction mechanism relative to the base, so that the bearing pedestals of the speed reduction mechanism can be accurately positioned relative to the base.

In the elevator hoist apparatus, the positioning means comprises a base engagement portion which is an engagement portion formed in the base, a bearing pedestal engagement portion which is an engagement portion formed in the bearing pedestal of the speed reduction mechanism, and a positioning member in engagement with the base engagement portion and the bearing pedestal engagement portion to determine the relative position therebetween, so that the positioning means is simple in structure and easy in assembly.

In the elevator hoist apparatus, the bearing pedestals of the speed reduction mechanism comprise a plurality of bearing pedestals each supporting at least one of the parallel axis gears, so that each bearing pedestals are independent from each other and not excessively heavy, providing advantages not only upon assembly but also upon maintenance and inspection.

In the elevator hoist apparatus, at least one of the bearing pedestal of the speed reduction mechanism is at least partially supported by other of the bearing pedestals, so that all of the bearing pedestals do not have to have the securing means and the positioning means.

In the elevator hoist apparatus, the bearing pedestal of the speed reduction mechanism comprises a plurality of bearing pedestals each supporting at least one of the parallel axis gears and directly mounted to the base, so that each of the bearing pedestals are independent from each other and not excessively heavy, providing advantages not only upon assembly but also upon maintenance and inspection.

In the elevator hoist apparatus, the speed reduction gear mechanism includes an intermediate gear and the bearing pedestal supporting the intermediate gear is in engagement with and supported solely by the bearing pedestal supporting the input shaft and the bearing pedestal supporting the output shaft, so that the bearing pedestals supporting the intermediate gear of the speed reduction mechanism are not directly secured to the base, realizing a small number of parts and easy assembly.

In the elevator hoist apparatus, the speed reduction gear mechanism includes an intermediate gear and the bearing pedestal supporting the intermediate gear is integrally provided on one of the bearing pedestal supporting the input shaft and the bearing pedestal supporting the output shaft and is in engagement with and supported solely by the other of the bearing pedestal supporting the input shaft and the bearing pedestal supporting the output shaft.

The method for manufacturing an elevator hoist apparatus, comprises the steps of preparing a base, mounting to the base a speed reduction mechanism including an input shaft to be connected to a driving power source and an output shaft to be connected to a rope sheave, and mounting a cover for covering the speed reduction mechanism to the base, so that the assembly of the speed reduction mechanism is easy.

The method for manufacturing an elevator hoist apparatus, comprises the steps of forming a base engagement portion in the base, forming a bearing pedestal engagement portion in the bearing pedestal, combining the bearing pedestals and the parallel axis gears to assemble the speed reduction mechanism, fitting a positioning member to the base engagement portion and the bearing pedestal engagement portion to position the bearing pedestal of the speed reduction mechanism with respect to the base, fixing the speed reduction gear mechanism to the base, and fixing a cover for covering the speed reduction gear mechanism to the base, so that the assembly of the speed reduction mechanism is easy and positioning can be accurately achieved.

What is claimed is:

1. An elevator hoist apparatus comprising:

a base;

a speed reduction mechanism mounted on said base and including an input shaft to which the driving power source is to be connected and an output shaft to Which a sheave is connected, said speed reduction mechanism including at least one bearing pedestal mounted to said base and a plurality of parallel axis gears, at least one of the parallel axis gears being solely supported by the at least one bearing pedestal; and a cover mounted to said base and covering said speed reduction mechanism.

2. An elevator hoist apparatus as claimed in claim 1 further comprising positioning means, disposed between said base and said at least one speed reduction mechanism, for positioning said bearing pedestal of said speed reduction mechanism relative to said base.

3. An elevator hoist apparatus as claimed in claim 2 wherein said positioning means comprises a base engagement portion, a bearing pedestal engagement portion, and a positioning member in engagement with said base engagement portion and said bearing pedestal engagement portion to determine the relative position therebetween.

4. An elevator hoist apparatus as claimed in claim 1, wherein said speed reduction mechanism includes a plurality of bearing pedestals each bearing pedestal supporting at least one of said parallel, axis gears.

5. An elevator hoist apparatus as claimed in claim 4, wherein at least one of the bearing pedestal of said speed reduction mechanism is at least partially supported by another one of said bearing pedestals.

6. An elevator hoist apparatus as claimed in claim 2, wherein the bearing pedestal of said speed reduction mechanism includes a plurality of bearing pedestals, each bearing pedestal supporting at least one of said parallel axis gears and each bearing pedestal being directly mounted to said base.

7. An elevator hoist apparatus as claimed in claim 1, wherein said speed reduction mechanism includes an input gear, an output gear and an intermediate gear disposed between the input and output gears and wherein said speed reduction mechanism includes a second bearing pedestal coupled to the input shaft and providing support for the parallel axis gear coupled to the input shaft and a third bearing pedestal coupled to the output shaft and providing support for the parallel axis gear coupled to the output shaft, one of the first pair of said bearing pedestals being in engagement with and supported solely by the second and third bearing pedestals.

8. An elevator hoist apparatus as claimed in claim 2, wherein said speed reduction mechanism includes an intermediate gear, an input gear and an output gear and wherein said speed reduction mechanism includes a first pair of bearing pedestals supporting the intermediate gear, the input gear and a third pair of bearing pedestals supporting the output gear, one of the first pair of bearing pedestals being integrally provided on one of the second and third pair of bearing pedestals and being in engagement with and supported by another bearing pedestal belonging to the other of the second and third pair of bearing pedestals.

9. A method for manufacturing an elevator hoist apparatus comprising the steps of preparing a base, mounting to said base a speed reduction gear mechanism including an input shaft to be connected to a driving power source, an output shaft to be connected to a rope sheave, and a plurality of parallel axis gears, and mounting a cover to said base for covering said speed reduction gear mechanism;

said method further comprising the steps of:

forming a base engagement portion in said base;

forming a bearing-mount engagement portion in a plurality of bearing pedestals each of the plurality of bearing pedestals including a bearing pedestal engagement portion;

combining the bearing pedestals and the plurality of parallel axis gears to assemble the speed reduction gear mechanism;

fitting a positioning member to the base engagement portion of the base and the bearing pedestal engagement portion of each bearing pedestal to position the bearing pedestals of the speed reduction gear mechanism with respect to the base;

fixing said speed reduction gear mechanism to said base; and fixing a cover for covering said speed reduction gear mechanism to said base.

* * * * *

UNITED STATES PATENT AND TRADEMARK OFFICE

CERTIFICATE OF CORRECTION

PATENT NO. : 5,547,044

DATED : August 20, 1996

INVENTOR(S) : Yamasaki

It is certified that error appears in the above-indentified patent and that said Letters Patent is hereby corrected as shown below: Title page:

Item 57: Abstract; Line 1, change "con,rising" to --comprising--;

Column 8, Line 62, change "Which" to --which--;

Column 9, Line 6, after "said" (first occurrence) insert --at least one--;

Line 17, after "pedestals" insert --,--;

Line 22, change "2" to --1--;

Column 10, Line 1, change "2" to --1--.

Signed and Sealed this
Twenty-eighth Day of January, 1997

Attest:

Bruce Lehman

BRUCE LEHMAN

Attesting Officer

Commissioner of Patents and Trademarks